US005411368A

United States Patent [19]

Chase et al.

[11] Patent Number: 5,411,368

[45] Date of Patent: May 2, 1995

[54] CERAMIC-TO-METAL STATOR VANE ASSEMBLY WITH BRAZE

[75] Inventors: Donna J. Chase; Ho T. Fang, both of Scottsdale; Craig W. Irwin, Tempe; James L. Schienle, Phoenix, all of Ariz.

[73] Assignee: AlliedSignal Inc., Morris Township, Morris County, N.J.

[21] Appl. No.: 148,483

[22] Filed: Nov. 8, 1993

[51] Int. Cl.[6] ..... E01D 9/04

[52] U.S. Cl. ..... 415/189; 415/200; 415/209.2; 415/209.3; 29/447; 29/889.22; 228/132; 228/178; 403/28; 403/273

[58] Field of Search ..... 415/135, 136, 137, 189–191, 415/200, 209.2, 209.3, 209.4; 29/446, 447, 889.22; 228/132, 133, 134, 178; 403/28, 29, 273

[56] References Cited

U.S. PATENT DOCUMENTS

| | | | |
|---|---|---|---|
| 2,834,537 | 5/1958 | Neary . | |
| 3,708,242 | 1/1973 | Bruneau et al. . | |
| 3,836,282 | 9/1974 | Mandelbaum et al. . | |
| 3,849,023 | 11/1974 | Klompas . | |
| 3,857,649 | 12/1974 | Schaller et al. | 415/200 |
| 3,867,065 | 2/1975 | Schaller et al. . | |
| 3,966,353 | 6/1976 | Booher, Jr. et al. . | |
| 4,009,969 | 3/1977 | Kadera et al. . | |
| 4,053,257 | 10/1977 | Rahaim et al. | 415/209.4 |
| 4,076,451 | 2/1978 | Jankot | 415/209.2 |
| 4,722,630 | 2/1988 | Fang . | |
| 4,798,320 | 1/1989 | Fang . | |
| 5,073,085 | 12/1991 | Ito et al. . | |
| 5,074,749 | 12/1991 | Fouillot et al. . | |
| 5,074,752 | 12/1991 | Murphy et al. . | |
| 5,104,747 | 4/1992 | Makino et al. | 403/29 |
| 5,105,625 | 4/1992 | Bell, III et al. . | |
| 5,129,783 | 7/1992 | Hayton . | |

OTHER PUBLICATIONS

Technical Paper entitled "Ceramics-to-Metal Joining Technology for Gas Turbine Rotors" by T. Sakamoto, H. Horinouchi and T. Maeda (pp. 1–6), copyright 1988, SAE, Inc.

Technical Paper entitled "Development of Brazing Technology for Ceramic Turbocharger Rotors" by Masaya Ito, Noboru Ishida and Norio Kato (pp. 55–63), presented at the Gas Turbine and Aeroengine congress and Exposition, Jun. 4–8, 1989, Toronto, Ontario, Canada.

*Primary Examiner*—Edward K. Look
*Assistant Examiner*—Christopher Verdier
*Attorney, Agent, or Firm*—Jerry J. Holden; James W. McFarland

[57] ABSTRACT

A stator vane assembly for a gas turbine engine that includes a plurality of circumferentially spaced ceramic vanes, each of which has an inner and outer ceramic shroud, and a ceramic post extending from one of the shrouds, and a metallic platform having a plurality of circumferentially spaced recesses. The posts are inserted into a metallic sleeve and then brazed. The brazed sleeves are then mounted in the recesses. A method for assembling these components to form the stator assembly is also described.

4 Claims, 2 Drawing Sheets

FIG. 1
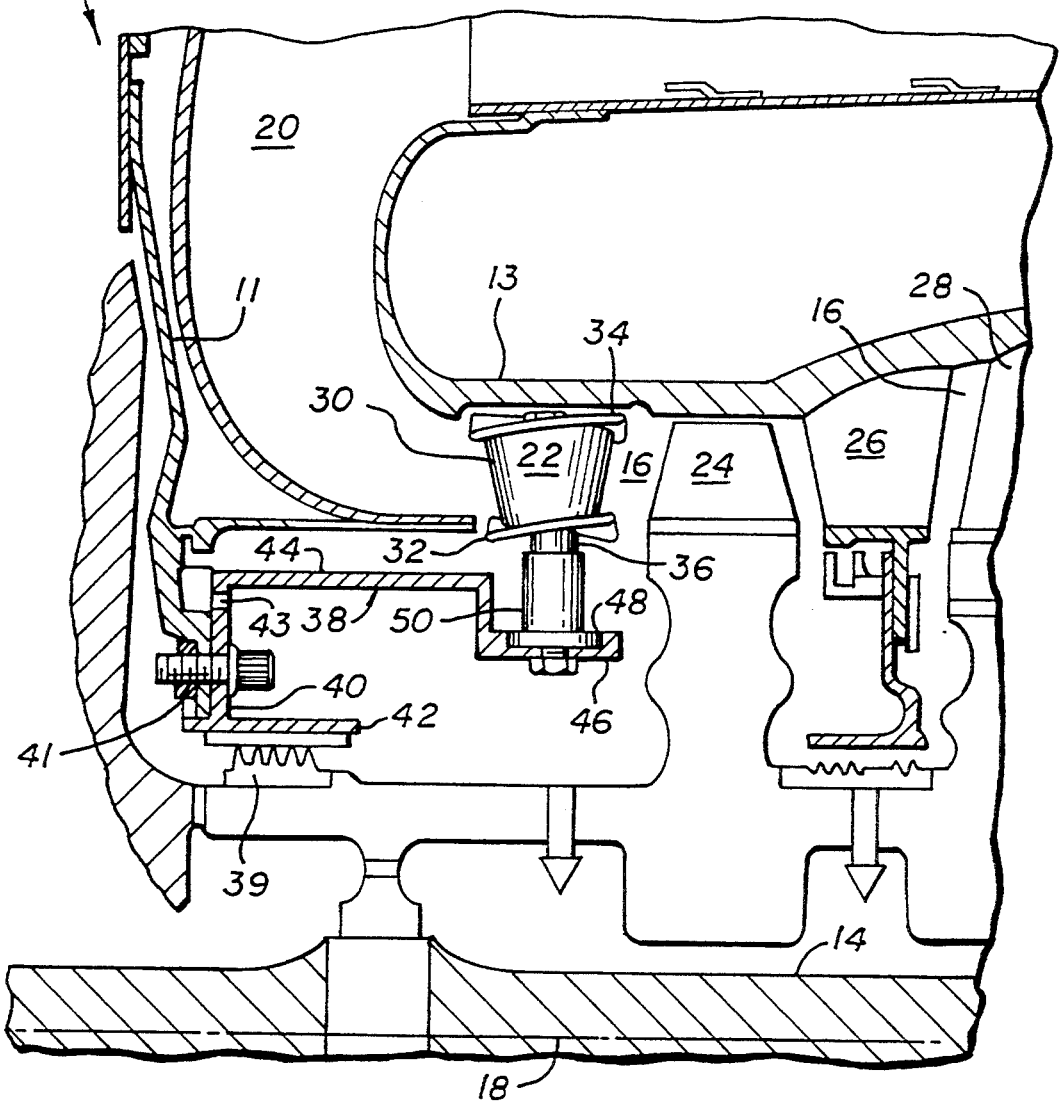
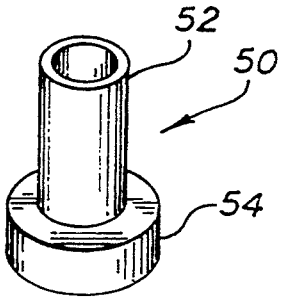
FIG. 2
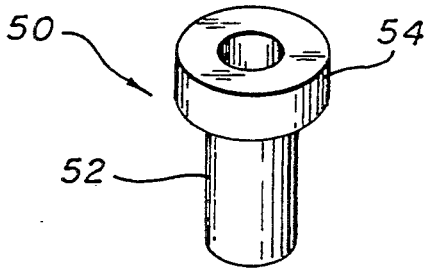
FIG. 3

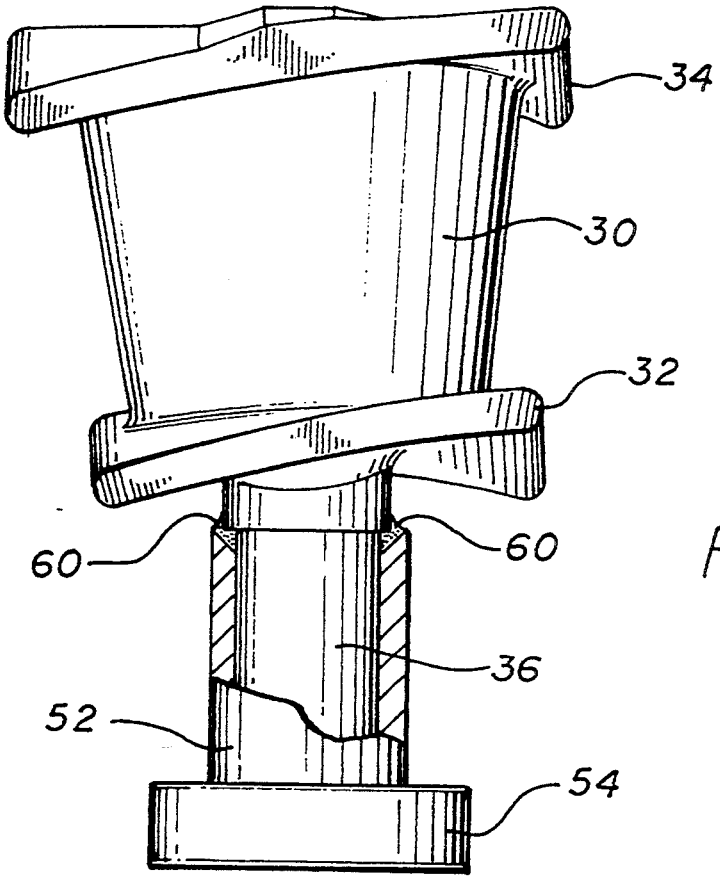
FIG. 4
FIG. 5
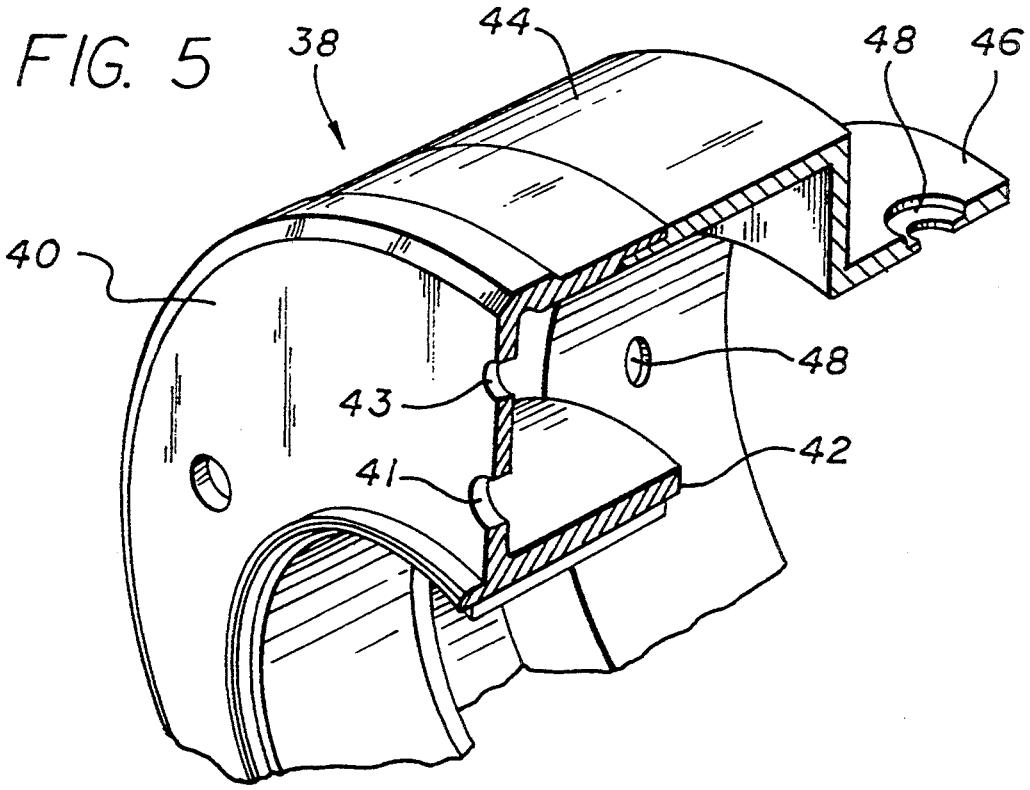

CERAMIC-TO-METAL STATOR VANE ASSEMBLY WITH BRAZE

The Government of the United States of America has rights in this invention pursuant to Contract No. DEN3-335 awarded by the U.S. Department of Energy.

TECHNICAL FIELD

This invention relates to gas turbine engines, and in particular, to a stator vane assembly having ceramic stator vanes mounted to a metallic support structure.

BACKGROUND OF THE INVENTION

It has long been recognized that the efficiency and performance of gas turbine engines could be improved by increasing the temperature of the gas through the turbine section. Historically, these temperatures have been limited by the materials, usually high temperature steel or nickel alloy, used to form the first stage stator vanes. To permit higher gas temperatures it has been proposed to form the first stage stator vanes from a high density, high strength, silicon nitride, or silicon carbide ceramic which can withstand higher temperatures than steels or nickel alloys. However, the use of ceramic stator vanes necessitates a ceramic-to-metal interface at which the difference in thermal expansion between the ceramic vane and the metallic support structure must be accommodated so that the vanes remain fixed relative to the structure despite temperature changes in the gas. It also necessitates that the ceramic-to-metal interface prevent the vanes from twisting when subjected to aerodynamic loads.

Thus, there is a need for a stator vane assembly in a gas turbine engine in which ceramic stator vanes are mounted to a metallic support structure in such a way so as accommodate the thermal mismatch between ceramic and metallic.

SUMMARY OF THE INVENTION

An object of the present invention is to provide a stator vane assembly for gas turbine engines having ceramic stator vanes.

Another object of the present invention is to provide a method for mounting ceramic stator vanes in a gas turbine engine.

The present invention achieves these objectives by providing a stator vane assembly for a gas turbine engine that includes a plurality of circumferentially spaced ceramic vanes, each of which has an inner and outer ceramic shroud, and a ceramic post extending from one of the shrouds, and a metallic platform having a plurality of circumferentially spaced recesses. The posts are inserted into a metallic sleeve and then brazed. The brazed sleeves are then mounted in the recesses. A method for assembling these components to form the stator assembly is also described. The braze is flexible and accommodates the thermal mismatch between the ceramic post and metallic sleeve, while the sleeve protects the brittle ceramic post.

BRIEF DESCRIPTION OF THE DRAWINGS

FIG. 1 is a cross sectional view of a portion of a gas turbine engine having a stator vane assembly contemplated by the present invention.

FIGS. 2 and 3 are two different perspective views of the metal sleeve of the stator vane assembly of FIG. 1.

FIG. 4 is a perspective view of a stator vane and sleeve of the stator vane assembly of FIG. 1.

FIG. 5 is a perspective view of annular support structure 38.

DESCRIPTION OF THE PREFERRED EMBODIMENT

FIG. 1 shows a partial view of the turbine section 10 of a gas turbine engine. The turbine section 10 is conventional in that it has a nonrotating metallic casing, that includes walls 11 and 13, circumscribing a rotating shaft 14 to define a flow path 16 therebetween. The flow path 16 extends axially, parallel to the engine's center line 18, from the combustor 20 towards the engine's exhaust, not shown. Operably disposed within the flow path 16 are a plurality of stator assemblies 22, 26 and rotor assemblies 24, 28. The stator assemblies 22, 26 are mounted to the metallic casing and the rotor assemblies 24, 28 are mounted to the shaft 14. The hot gas exiting the combustor 20 is expanded across the turbine section 10 causing the rotor assemblies 24, 28, and hence the shaft 14 to rotate.

The stator assembly 22 includes a plurality of stator vanes 30, also referred to as nozzles. Each vane 30 is bounded radially, relative to the engine centerline 18, by an inner shroud 32 and an outer shroud 34. Extending radially inward from the inner shroud 32 is a post 36. The post 36 is preferably cylindrical, though other shapes are contemplated to work as effectively. In addition, the post 36 can be curved. The vane 30, shrouds 32, 34, and post 36 are all integrally formed from a ceramic such as silicon carbide or silicon nitride. In addition, the vanes 30 are formed with the post 36 off center from the radial centerline of the vane 30.

The stator assembly 22 further includes an annular metallic support structure 38. The shape and configuration of the structure 38 can vary greatly depending on the particular engine in which it is mounted, and on the particular stator assembly receiving the ceramic vanes 30. In the preferred embodiment shown in FIG. 1 where the vanes 30 are being mounted in the first turbine stage, the support structure 38 has a radially extending annular wall 40 having bolt holes 41 and cooling air holes 43. Extending axially from the wall 40 toward the rear of the engine are two radially spaced walls 42 and 44. The inner wall 42 has a flat inner surface that, after mounting, abuts a seal 39 that is part of the rotor assembly 24. The outer wall 44 extends further than the inner wall 42 and has at its axial end a platform 46 having a plurality of circumferentially spaced recesses 48. The outer wall 44 may be hollow.

A metal sleeve 50 is used for mounting each stator vane 30 to the platform 46. The sleeve 50 is made from metal alloy, such as Inconel 4005, having a low thermal expansion coefficient. The sleeve 50 is comprised of a tube portion 52 and a base portion 54. Of course, the diameter and shape of the tube portion 52 is selected so that it can receive the post 36. After the post 36 has been inserted in the tube portion 52, a braze alloy 60 is disposed, in a manner familiar to those skilled, between the inner surface of the sleeve 50 and the outer surface of the post 36. The braze alloy is Gold Nickel (82 18) available from GTE-WESGO under the name of "Nioro". During the brazing, the tube 52 shrinks down around the post 36 resulting in a brazed and shrink fit attachment. The base portion 54 is then mounted in one of the recesses 48 in the platform 46 and bolted thereto. Alternatively, the base portion could be secured to the platform 46 by a pinned attachment, a dovetail attachment, a braze, or a weld. Once each of the vanes 30 has been mounted to the platform 46, the platform 46 is bolted to the wall 11.

Thus, in the stator vane assembly 22 the vanes 30 remain fixed relative to the support structure 38 despite temperature changes in the gas. The braze is flexible and accommodates the thermal mismatch between the ceramic post 36 and metallic sleeve 50, while the sleeve 50 protects the brittle ceramic post 36 from contact with the surrounding metal structure.

Various modifications and alterations to the above described embodiment will be apparent to those skilled in the art. For example, the present invention could be used to attach ceramic turbine nozzles to a metallic housing housing in a radial turbine. Accordingly, this description of the invention should be considered exemplary and not as limiting the scope and spirit of the invention as set forth in the following claims.

What is claimed is:

1. A stator vane assembly for a gas turbine engine comprising:

a plurality of circumferentially spaced ceramic vanes, each of said vanes having a ceramic post extending therefrom;

a plurality of metal sleeves configured for receiving respective ones of said ceramic posts;

a braze alloy disposed between said sleeves and said posts;

a support member having a plurality of circumferentially spaced recesses for receiving each of said sleeves; and means for attaching said sleeves to said recesses.

2. The stator vane assembly of claim 1 wherein said sleeves are formed from a superalloy, said vanes are silicon nitride, and said braze alloy is 82 weight percent Gold and 18 weight percent Nickel.

3. A method for mounting ceramic stator vanes in a gas turbine engine having a metallic casing circumscribing a metallic shaft, comprising the steps of:

providing each of said ceramic stator vanes with a ceramic post extending therefrom;

providing a metallic platform having a plurality of circumferentially spaced recesses;

inserting each of said posts into a metallic sleeve;

brazing said posts to said sleeves; and mounting said brazed sleeves in said recesses.

4. The method of claim 3 further comprising the step of mounting said platform to said casing.

* * * * *